US007310897B2

(12) United States Patent
Tillessen et al.

(10) Patent No.: US 7,310,897 B2
(45) Date of Patent: Dec. 25, 2007

(54) BIT HOLDER FOR A PLOUGHING BIT AND PLOUGHING BIT

(75) Inventors: Uwe Tillessen, Kamen (DE); Norbert Hesse, Bochum (DE); Gerhard Siepenkort, Lünen (DE); Klaus Duhnke, Bochum (DE); Adam Klabisch, Dortmund (DE)

(73) Assignee: DBT GmbH, Lunen (DE)

( * ) Notice: Subject to any disclaimer, the term of this patent is extended or adjusted under 35 U.S.C. 154(b) by 354 days.

(21) Appl. No.: 11/000,275

(22) Filed: Nov. 30, 2004

(65) Prior Publication Data

US 2005/0150667 A1 Jul. 14, 2005

(30) Foreign Application Priority Data

Dec. 29, 2003 (DE) ..... 203 20 163 U

(51) Int. Cl.
*E02F 9/28* (2006.01)
*E21C 25/10* (2006.01)

(52) U.S. Cl. ..... 37/455; 299/108; 299/34.04

(58) Field of Classification Search ..... 37/452, 37/455; 299/108, 112, 34.04, 34.01
See application file for complete search history.

(56) References Cited

U.S. PATENT DOCUMENTS 2,613,069 A * 10/1952 Bruestle ..... 299/102
2,901,233 A * 8/1959 Brown ..... 299/108
3,205,015 A * 9/1965 Krekeler ..... 299/108
3,820,849 A * 6/1974 Lundstrum et al. ..... 299/108
3,834,764 A * 9/1974 Krekeler ..... 299/108
3,844,619 A * 10/1974 Haller ..... 299/108
4,180,292 A * 12/1979 Persson ..... 299/108
4,609,227 A * 9/1986 Wild et al. ..... 299/103
4,744,605 A * 5/1988 Komotzki ..... 299/108
4,762,372 A * 8/1988 Rassmann et al. ..... 299/108
4,776,639 A * 10/1988 Braun et al. ..... 299/108
4,998,778 A * 3/1991 Braun et al. ..... 299/108
5,722,733 A * 3/1998 Tank et al. ..... 299/108
7,073,870 B2 * 7/2006 Tillessen et al. ..... 299/108

FOREIGN PATENT DOCUMENTS

DE 298 03 944 U1 4/1998
DE 299 01 985 U1 4/1999

* cited by examiner

*Primary Examiner*—Thomas A Beach
(74) *Attorney, Agent, or Firm*—Fay Sharpe LLP

(57) ABSTRACT

A bit holder for a ploughing bit of a coal or extraction plough includes an insert pocket open on the top side for receiving a bit shank formed on the ploughing bit. The pocket is bounded by two lateral supporting walls, a front and a rear supporting wall, whereby the rear supporting wall has an elevated section projecting over the adjoining, lateral supporting walls. The rear supporting wall forming a bit support for the ploughing bit slopes down to its outer regions. In order to allow a good support for an inserted bit and easy and fast installation of the bit the front face of the rear supporting wall is fitted on the outer regions with guiding surfaces sloping down inwards to the insert pocket as an installation aid for the ploughing bit.

20 Claims, 1 Drawing Sheet

BIT HOLDER FOR A PLOUGHING BIT AND PLOUGHING BIT

BACKGROUND

The invention relates to a bit holder for a ploughing bit of a coal or extraction plough. In one embodiment, the bit holder includes an insert pocket open on the top face for reception of a bit shank formed on the ploughing bit, which is bounded by two lateral supporting walls, a front and a rear supporting wall, whereby the rear supporting wall exhibits an elevated section that projects above the adjacent side supporting walls, forms a bit support for the ploughing bit, is arranged primarily or essentially in the central region of the rear supporting wall, and slopes down to its outer regions.

In the bit holder known from DE-U 298 03 944, the elevated section supporting the back face of the ploughing bit projects only a short distance above the lateral supporting walls and therefore offers only slightly better support for the bit than a bit holder in which all four supporting walls are approximately the same height. The slightly better support of the bit provided by the higher rear supporting wall is generally associated with the disadvantage that coal dust can be deposited and compacted in the region of the rear supporting wall, as a result of which it is far more difficult to dismantle the bit. The reason for the increased accumulation of coal dust in the region of the higher rear supporting wall lies in the fact that the elevated section in the case of bit holders of known art is provided over practically its whole width and as a result a kind of gusset-type fillet groove is formed at the side near the inserted bit between the lateral supporting walls and the outer higher regions of the rear supporting wall, in which the fine coal can easily be deposited.

In order to avoid the disadvantages of an undesired deposit of fine coal in the transition region between the lateral supporting walls and the rear supporting wall it is proposed in the generic DE 299 01 985 to form the elevated section only in the central region of the rear supporting wall, whereby the rear supporting wall is then to slope down to its outer regions, as a result of which the front of the rear supporting wall, facing the ploughing bit and the insert pocket, exhibits in the outer regions deflectors that slope down and run outwards in the opposite direction to the work flow of the ploughing bit. As the elevated section forming the bit support only projects slightly at the side above the inserted ploughing bit, there is no significant dead space between the ploughing bit, the lateral supporting walls and the outer regions of the rear supporting wall. In addition, the deflectors aligned diagonally against the work flow direction of the ploughing bit are to ensure that fine coal that is blown against the work flow direction of the ploughing bit from its bit tip in the direction of the rear supporting wall, is guided diagonally outwards.

The generic bit holder reduces the tendency for fine coal to collect in the gusset, however, the installation of a new bit, e.g. in the event of replacement of all or individual ploughing bits as required by wear and tear, is made considerably more difficult as a result of the configuration with the outward-directed deflectors, extending almost as far as the insert pocket.

Thus, there is a need for a bit holder that allows good support for an inserted bit and easy and fast installation of the bit.

SUMMARY

According to one aspect of the invention, a bit holder for a ploughing bit of a coal or extraction plough if provided. More particularly, in accordance with this aspect, the bit holder includes an insert pocket open on the top face for reception of a bit shank formed on the ploughing bit, which is bounded by two lateral supporting walls, a front and a rear supporting wall. A front surface or face of the rear supporting wall facing the insert pocket is fitted with guiding surfaces that slope down inwards diagonally to the insert pocket in the outer regions as an installation aid for the ploughing bit. The guiding surfaces that slope down to the insert pocket ease the insertion of the ploughing bit considerably, as even a bit that is introduced slightly tilted is aligned relative to the insert pocket as a result of the guiding surfaces. The front wall still serves as a rearward support for the ploughing bit. At the same time the guiding surfaces can also act to deflect the fine coal away from the insert pocket.

In a preferred embodiment the lateral supporting walls can be configured level on their upper top faces essentially over the whole thickness and/or configured as sloping diagonals to the longitudinal centre plane of the insert pocket. Preferably both top faces here run relative to the longitudinal centre plane with a slope angle of around 93°. This alignment of the top faces of the lateral supporting walls improves the support of the bit inserted in the insert pocket as the bit with its bit head can lean or support itself against a large area of the top faces on both sides of the insert pocket. In addition, an undesired dead space between the bit head or bit shank and the bit holder is avoided and deflection of fine coal is achieved. In another preferred embodiment the guiding surfaces can extend above and partially also below the top faces of the lateral supporting walls in order to ensure that the ploughing bit is inserted with its bit shank under the height of the top faces.

For a beneficial bit support the front supporting wall can be fitted at the transition to the top faces of the lateral supporting walls with a supporting projection for the bit head of the ploughing bit, whereby the frontal area of the supporting projection is preferably fitted with a V-shaped recess in order to secure the bit head laterally also. The outer regions of the front face of the rear supporting wall can also preferably be arched to from a trough from the vertex of the elevated section to the top faces in the guiding surfaces and in the bounding surfaces that connect to the outer regions. The deflection of coal is further improved if for the bit holder the edges slope backwards to the lateral supporting walls, thus—as for bit holders of like kind—forming narrow deflectors aligned diagonally against the work flow direction of the plough that deflect the fine coal diagonally outwards. The narrow edges can in the extreme case be formed exclusively from the round transition sections beneficial for the manufacture by casting of a cast bit holder.

In alignment with the loads to which a bit holder is exposed during operation the latter preferably has as applicable an only slightly pronounced asymmetry of configuration of the lateral supporting walls and the outer regions of the rear supporting wall relative to the longitudinal centre plane of the insert pocket. It is expedient if the bit support formed by the rear supporting wall in its central maximum raised region, has a width that corresponds approximately with the width of the insert pocket. Thus the rear supporting wall in its central region is, at least near the preferably arched vertex of the rear supporting wall, either not or at the most slightly wider than the ploughing bit inserted in the insert pocket and the outer regions do not have to be configured over the whole height of the elevated section formed by the rear supporting wall, but in one preferred construction of the invention, are present only where the rear, elevated supporting wall section projects laterally over the inserted bit or the insert pocket, thus in the transition region to the lateral supporting walls.

BRIEF DESCRIPTION OF THE DRAWINGS

Other features and benefits of the invention can be seen from the following description and the drawings, in which one or more preferred embodiment of the invention are explained in more detail. In the drawings.

DETAILED DESCRIPTION

Figure 1:
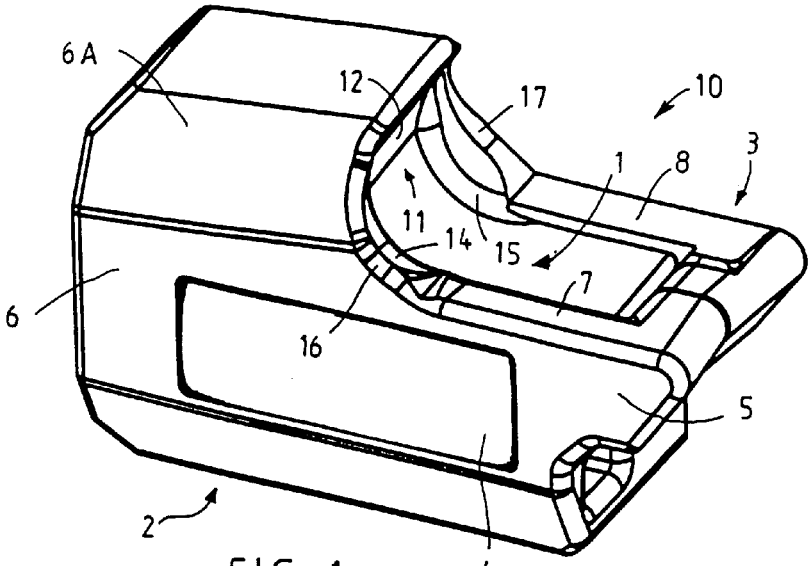
FIG. 1 is a representation in perspective of the bit holder in accordance with one aspect of the invention.
Figure 2:
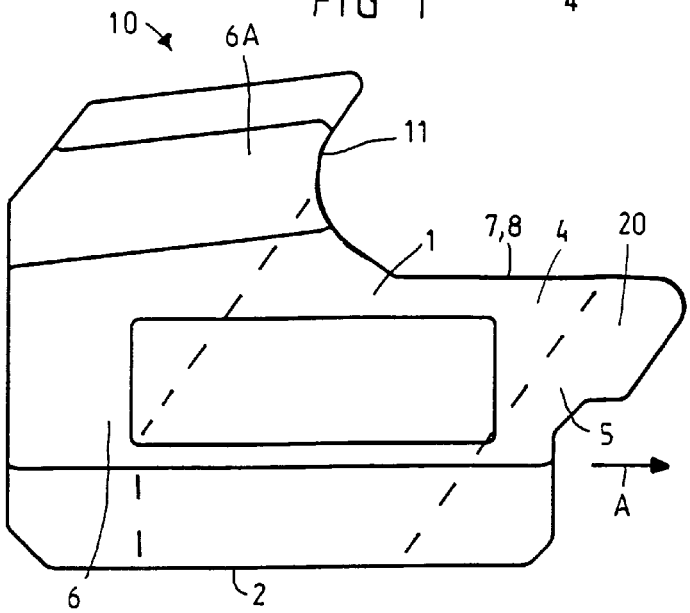
FIG. 2 a side view of the bit holder in accordance with FIG. 1.
Figure 3:
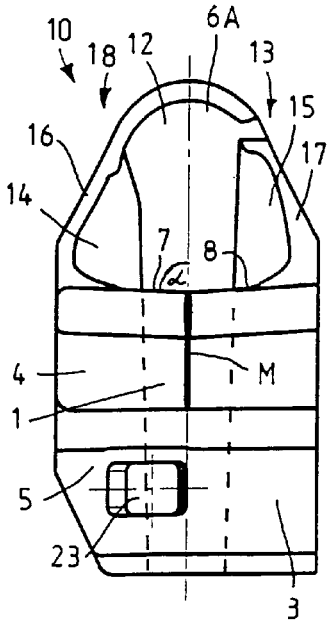
FIG. 3 a front view of the bit holder in accordance with FIG. 1.

A bit holder is denoted in the drawing with reference symbol 10 for a coal plough, of which no further details are shown, into whose insert pocket 1, open at least on the top face, a ploughing bit that is not shown can be inserted with its bit shank and anchored using suitable means for securing bits. Two lateral supporting walls 3, 4, a front supporting wall 5 and a rear supporting wall 6 project from the underside 2 of the bit holder 10 that enclose the edges of the insert pocket 1, as can in particular be seen from FIGS. 2 and 3 in which the position of the insert pocket 1 is denoted by dashed lines. The insert pocket 1 slopes diagonally to the back on its front and rear bounding surfaces formed by the supporting walls 4, 5 at an angle of inclination of approximately 55° relative to the ploughing work flow direction indicated in FIG. 2 by the arrow A. The lateral bounding surfaces of the insert pocket 1 formed by the lateral supporting walls 3,4 diverge by a small sloping angle of around 1.8° relative to the longitudinal centre plane M of the insert pocket 1 so that the insert pocket widens slightly in a wedge-shaped manner from the underside 2 upwards in order to achieve a beneficial anchoring by shape of the correspondingly adapted bit shank that can be inserted into the insert pocket 1.

Figure 4:
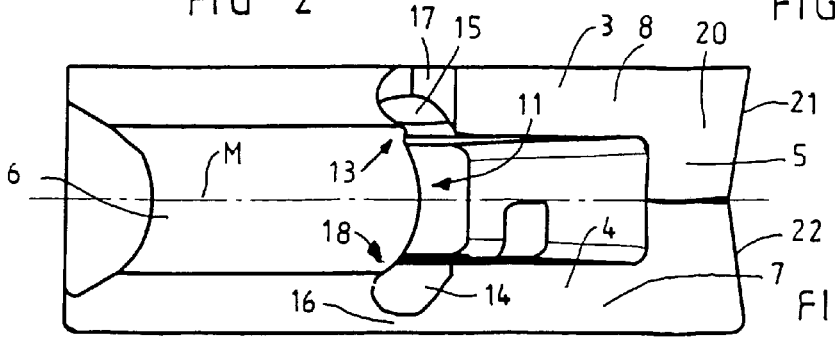
FIG. 4 a plan view of the bit holder in accordance with FIG. 1.

As can be clearly seen from the Figures, the rear supporting wall 6 projects above the top faces 7, 8 of both lateral supporting walls 3,4 and the front supporting wall 5 by approximately ⅓ of their total height with a rear supporting wall section 6A. The supporting wall section 6A therefore forms an elevated section, whose front face 11 pointing in the ploughing work flow direction A and facing the insert pocket 1 provides an additional rear support for the back of a ploughing bit inserted into the bit holder 10. The front face 11 is arched to form a trough, as can especially be clearly seen in FIG. 2. The front face 11 of the supporting wall section that is the elevated section 6A has a central region 12, which extends across the width of the insert pocket 1, and two outer regions 13, 18, which lie above the top faces 7, 8 of the lateral supporting walls 3, 4 respectively, and which are fitted with guiding surfaces 14, 15 respectively that slope downwards and slant inwards towards the insert pocket 1. These guiding surfaces 14, 15 serve as an installation aid in the guidance of the bit shank into the insert pocket 1 during installation of the bit, and they also run partially below the top faces 7, 8. The two edge regions 16, 17 that adjoin the guiding surfaces respectively at the side, i.e. at the transition to the lateral supporting walls 3, 4, slope laterally towards the back and thus form lateral guiding surfaces for the deflection of fine coal. As can be seen clearly from FIGS. 3 and 4 the guiding surfaces 14, 15 differ slightly in configuration so that the complete bit holder 10 is configured asymmetrically with respect to the longitudinal centre plane M. Furthermore, the configuration is such that the elevated section 6A forming the actual bit support is configured primarily in the central region of the rear supporting wall 6 over a width that approximately corresponds with the width of the insert pocket.

Both top faces 7, 8 are inclined by approximately 3° from outside to inside of the insert pocket 1 as slopes so that the sloping angle $\alpha$ with the longitudinal centre plane 11 is approximately 93°. A supporting projection 20 is arranged to provide front face support for a ploughing bit at the transition of the top faces 7, 8 into the front supporting wall 5. The front faces 21, 22 of the supporting projection 20 slope backwards by approximately the same sloping angle as the front and rear bounding surfaces of the insert pocket and they run together at an obtuse angle of around 170°. In this way a V-shaped recess is formed that can support the ploughing bit head (not shown) laterally. The supporting projection 20 projects far above an opening 23 in the front supporting wall 5 so that a bolt head of a bit securing bolt in the bit insert can fit protected in the outer face of the front supporting wall 5.

The exemplary embodiment has been described with reference to the embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

By means of the elevated section 6A of the bit support compared with the other supporting walls 3, 4, 5 a ploughing bit inserted in the insert pocket 1 has a particularly large contact surface as a result of which the surface pressures in this region, which is exposed to the most load, are always comparably low and as a result of which also the life of the bit and the bit holder is improved compared with bit configurations of known art. The forces exercised on the bit holder by the ploughing bit when the plough is in operation can be absorbed very well by the bit holder via the projecting, rear support surface and in particular the moments exercised by the bit are well absorbed by the bit holder, since as a result of the larger support surface separations compared with state-of-the-art technology the loads resulting from the moments are lower. As a result of the slim, high bit support only in the centre of the supporting wall section 6A of the rear supporting wall 6 the entry, retention and compaction of fine coal is reliably prevented in this region of the bit configuration.

The invention claimed is:

1. Bit holder for a ploughing bit of a coal or extraction plough comprising: an insert pocket open on the top side for receiving a bit shank formed on the ploughing bit, which on edges thereof is bounded by two lateral supporting walls, and a front and a rear supporting wall, whereby the rear supporting wall has an elevated section projecting over the adjoining, lateral supporting walls, which rear supporting wall forms a bit support for the ploughing bit, the bit holder configured in the center of the rear supporting wall and slopes down to outer regions thereof, wherein a front face of the rear supporting wall facing the insert pocket is fitted on the outer regions with guiding surfaces angled relative to the center of the rear wall and sloping down inwards to the insert pocket as an installation aid for the ploughing bit, the guiding surfaces extending above and partially below top faces of the lateral supporting walls.

2. Bit holder in accordance with claim 1, wherein the lateral supporting walls are configured as level on their respective upper top faces essentially over their whole thickness and/or are configured as slopes slanting down to a longitudinal center plane of the insert pocket, said top upper faces being nearer said elevated section than lower faces of the lateral supporting walls.

3. Bit holder in accordance with claim 2, wherein both top faces run relative to the longitudinal center plane with a slope angle of approximately 93°.

4. Bit holder in accordance with claim 1, wherein the front supporting wall is fitted on a transition to the top faces of the lateral supporting walls with a supporting projection for a bit head of a ploughing bit, whereby the front face of the supporting projection is fitted with a V-shaped recess.

5. Bit holder in accordance with claim 1, wherein the outer regions of the front face of the rear supporting wall are arched to form a trough from a vertex of the elevated section to top faces in the guiding surfaces and in bounding surfaces that connect to the outer regions.

6. Bit holder in accordance with claim 1, wherein bounding surfaces slope down backwards to the lateral supporting walls.

7. Bit holder in accordance with claim 1, having an asymmetrical configuration of the lateral supporting walls and the outer regions of the rear supporting wall relative to the longitudinal center plane of the insert pocket.

8. Bit holder in accordance with claim 5, wherein bounding surfaces slope down backwards to the lateral supporting walls.

9. Bit holder in accordance with claim 1 wherein the center of the rear supporting wall extends across and is generally parallel to the width of the insert pocket, said guiding surfaces angularly disposed relative to the width and the length of the inert pocket.

10. A bit holder for a ploughing bit of a coal or extraction plough, comprising:

a bit holder body defining an insert pocket open on a top side for receiving a bit shank of an associated ploughing bit, said bit holder body including a front wall, a rear wall and two opposed, lateral supporting walls, all together defining said insert pocket, said rear wall having an elevated section projecting over said lateral supporting walls for supporting the associated ploughing bit, said rear wall having a central region extending across a width of said insert pocket and having outer regions flanking said central region, said outer regions having guiding surfaces angularly disposed relative to said central region and sloping inwards to said insert pocket.

11. The bit holder of claim 10 wherein said rear wall includes a front face that is arched to form a trough.

12. The bit holder of claim 10 wherein said lateral supporting walls have upper faces over which said elevated section projects, said upper faces sloping downward into said insert pocket toward a longitudinal center thereof.

13. The bit holder of claim 12 wherein said upper faces have a slope angle of approximately 93°.

14. The bit holder of claim 10 wherein the guiding surfaces extend above and partially below top faces of said lateral supporting walls, said top faces being adjacent said elevational section of said rear wall.

15. The bit holder of claim 10 wherein a transition between said front supporting wall and said top faces of said lateral supporting walls defines a supporting projection for a bit head of the ploughing bit, whereby a front face of said supporting projection includes a V-shaped recess.

16. The bit holder of claim 10 wherein said outer regions include inwardly disposed guiding surfaces that slope down inwards to said insert pocket and edge regions disposed outwardly relative to said guiding surfaces that slope backwards away from said insert pocket to said lateral supporting walls.

17. The bit holder of claim 10 having an asymmetrical configuration of said lateral supporting walls and said outer regions of said rear supporting wall relative to a longitudinal center plane of said insert pocket.

18. A bit holder for a ploughing bit of a coal or extraction plough, comprising:

a front wall;

a rear wall spaced apart from said front wall;

a pair of space apart lateral supporting walls extending between said front wall and said rear wall;

an insert pocket open on a top side thereof, said insert pocket bounded by said front wall, said rear wall and said pair of spaced apart lateral supporting walls;

wherein said rear wall includes an elevated section extending above said lateral supporting walls, a central region of said rear wall is at least partially disposed on said elevated section and slopes down to outer regions of said rear wall, said outer regions flanking said central region and having guiding surfaces partially opposed to one another that slope down inwards toward said insert pocket for aiding in the installation of the ploughing bit.

19. The bit holder of claim 18 wherein each of said pair of lateral supporting walls is level on a top surface thereof that is adjacent said top side of said insert pocket and said elevated section of said rear wall and/or slopes down inward toward said insert pocket.

20. The bit holder of claim 18 wherein said guiding surfaces each extend above each top surface of said pair of lateral supporting walls and at least partially below said each top surface.

* * * * *